US005092399A

United States Patent [19]

Lang

[11] Patent Number: 5,092,399

[45] Date of Patent: Mar. 3, 1992

[54] APPARATUS FOR STABBING AND THREADING A DRILL PIPE SAFETY VALVE

[75] Inventor: Duane Lang, Tyler, Tex.

[73] Assignee: Master Metalizing and Machining Inc., Tyler, Tex.

[21] Appl. No.: 519,893

[22] Filed: May 7, 1990

[51] Int. Cl.[5] ..... E21B 19/16

[52] U.S. Cl. ..... 166/77.5; 166/78; 166/85

[58] Field of Search ..... 166/379, 77.5, 78, 85; 137/315

[56] References Cited

U.S. PATENT DOCUMENTS 4,423,774 1/1984 Mefford ..... 166/77.5
4,442,892 4/1984 Delesandri ..... 166/85
4,846,271 7/1989 Delesandri ..... 166/78

*Primary Examiner*—William P. Neuder
*Attorney, Agent, or Firm*—Arnold, White & Durkee

[57] ABSTRACT

An apparatus for automatically stabbing and threading a safety valve into a well pipe to prevent upward flow comprises a tubular canister rotatably mounted on a body that is slidably mounted on an upstanding frame to provide vertical movement of the safety valve and canister. The lower end of the frame is connected to a carriage that slidably moves perpendicular to the well pipe so as to transport the safety valve horizontally into direct longitudinal alignment with the well pipe before vertically lowering the safety valve into engagement with the well pipe. An elevator-type clamp connects the apparatus to the upper end portion of the well pipe prior to either vertical or horizontal movement of the safety valve. A variable drive mechanism is employed to simultaneously rotate and lower the canister, and the valve located therein, toward the pipe. The drive mechanism is adjustable to facilitate threading of the valve into a variety of drill pipe thread designs.

20 Claims, 5 Drawing Sheets

APPARATUS FOR STABBING AND THREADING A DRILL PIPE SAFETY VALVE

BACKGROUND OF THE INVENTION

1. Field of the Invention

The present invention relates to drill pipe safety valves used for capping oil field drill pipe when a blowout occurs through the pipe and, more particularly, to a hydraulicly and mechanically actuated apparatus for automatically positioning the safety valve over the drill pipe and threading the safety valve into the drill pipe.

2. Description of the Related Art

During the drilling of an oil well, the drill bit occasionally penetrates an earth formation that has an unexpectedly high pressure. When the pressure is sufficiently high, the hydrostatic head of drill mud standing in the well is not sufficient to prevent formation fluids from entering the bore hole and traveling upward toward the surface. If such flow is not controlled quickly, a "blowout" of the well occurs and creates very serious safety hazards for personnel working on and around the drilling rig. Further, resulting fire can cause tremendous damage to the drilling equipment.

At a first indication of possible blowout conditions, blowout preventers can be closed around the drill pipe to seal off the annulus. If a kelly by which the drill pipe is driven happens to be attached to the upper end of the string of drill pipe at the time of the potential blowout, then a valve may be present in the system which can be closed to shut off upward flow through the drill pipe itself. However, should upward flow begin while the kelly is not connected to the drill pipe, for example while a threaded connection between pipe sections is being made, a very hazardous situation is presented.

U.S. Pat No. 4,026,354, issued May 31, 1977, shows a somewhat massive device that is lowered over the open end of the pipe by a crane or a boom and operated by a long drive shaft that extends through a kill line to make a connection with the pipe and enable a shut-off valve to be closed. Due to its massive nature, this device cannot be positioned and put into operation as quickly as would obviously be desirable under the circumstances.

U.S. Pat. No. 3,625,282 issued Dec. 7 1971 shows device having a clamp that mates only with a special type of groove arrangement on the upper end of the casing. The clamp has bolt holes that can be aligned with matching holes on the lower flange of a spool where a master valve is mounted. The clamp and spool have an offset hinge bolt to enable the spool to be pivoted into position. However, this apparatus requires the construction of numerous bolts before complete attachment can be accomplished. This is, of course, time-consuming and, thus, potentially dangerous. Further, the clamp assembly is designed for attachment only to a specific type of machined end fitting.

U.S. Pat. No. 4,442,892, issued Apr. 17, 1984, shows an apparatus for stabbing and threading a safety valve into a well pipe. The apparatus includes a tubular canister rotatably mounted on a carriage assembly that is slidably mounted on an upstanding frame. The lower end of the frame has a swivel mounting to a bracket that is attached to the side of an elevator type clamp by which the apparatus is clamped onto the upper end portion of the pipe. After the apparatus is clamped onto the pipe, the operator manually operates a gear drive so as to swivel the apparatus in position over the pipe.

With the canister pivoted into position over the pipe, the operator manually operates a second gear drive to cause the canister to be rotated and simultaneously lowered toward the pipe whereby a safety valve mounted inside the canister is automatically threaded into the upper end of the pipe and can be closed to shut off upward flow. While the apparatus is generally satisfactory in operation, the gear drives are relatively complex mechanical devices and, therefore, expensive to manufacture and difficult to assemble.

The present invention is directed to overcoming one or more of the problems set forth above.

SUMMARY OF THE INVENTION

In one aspect of the present invention, an apparatus is provided for threading a valve into a will pipe for shutting off upward flow therethrough. The apparatus comprises means for attaching the apparatus to the well pipe, means for moving the valve into general alignment with a longitudinal axis of the well pipe, and adjustable drive means for coordinating rotation and vertical displacement of the valve. The drive means is operative to thread the valve into a plurality of drill pipe thread pitches.

BRIEF DESCRIPTION OF THE DRAWINGS

Other objects and advantages of the invention will become apparent upon reading the following detailed description and upon reference to the drawings in which.

Figure 1:
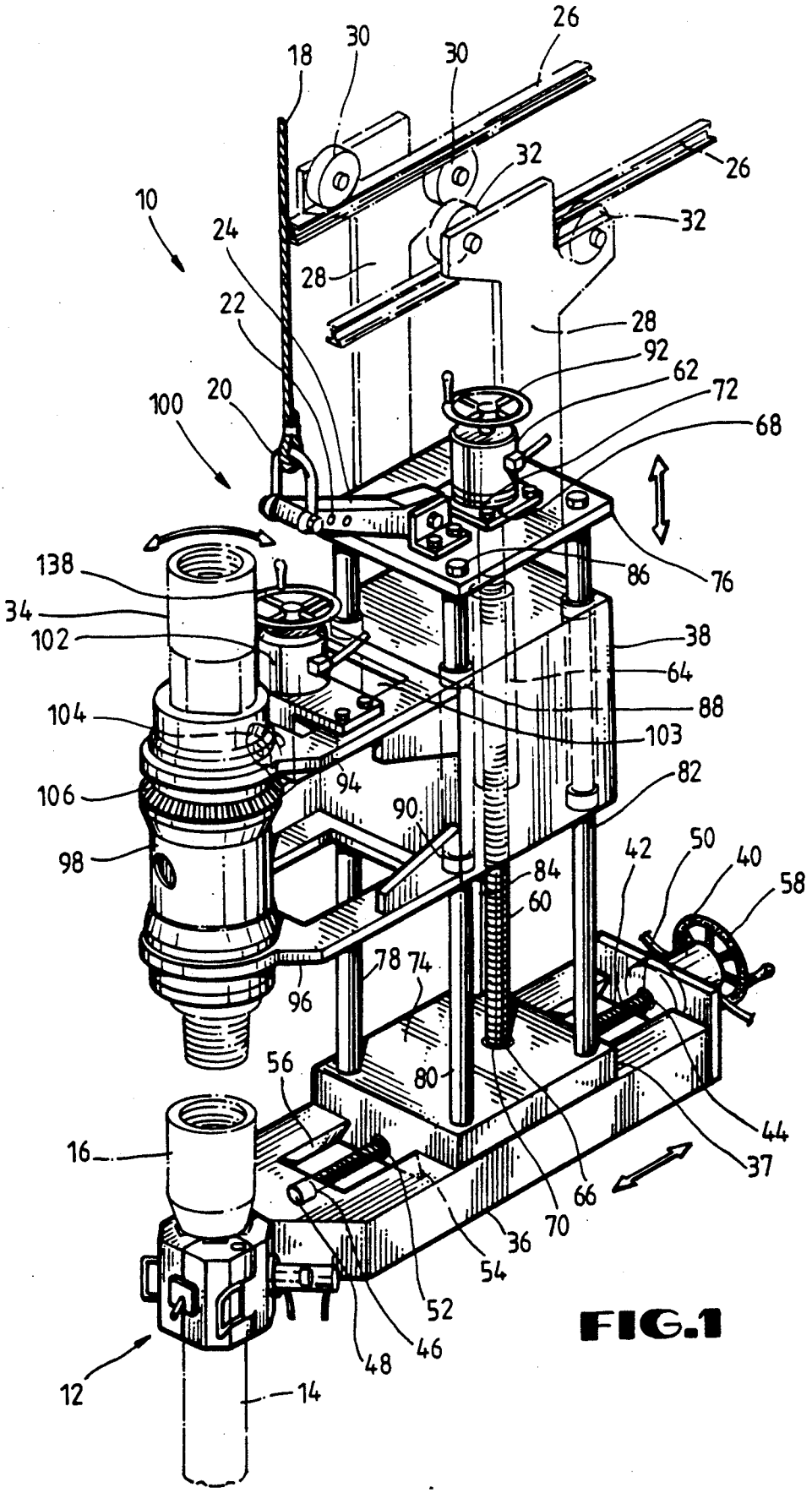
FIG. 1 is a perspective view of one embodiment of a safety valve stabbing apparatus utilizing the improved clamp assembly, drive assembly, and alignment assembly of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternative falling within the spirit and scope of the invention as defined by the appended claims.

DETAILED DESCRIPTION OF A PREFERRED EMBODIMENT

Referring to FIG. 1, an apparatus 10 constructed in accordance with the principles of the present invention is shown as including a clamp assembly 12 that is arranged to be positioned around the upper end portion of a joint of drill pipe 14 below an internally threaded box end 16 thereof. The drill pipe 14 is suspended by slip (not shown) in a rotary table (not shown) on the floor of a derrick (not shown).

The positioning of the apparatus 10 with respect to the drill pipe 14 is shown to be accomplished by two separate means. In a first embodiment, the apparatus 10 is suspended by a cable 18 from a counterweight (not shown). Preferably, the cable 18 attaches to the apparatus 10 through a U-shaped coupling 20 that passes through a selected one of a plurality of bore holes 22 in a cantilevered arm 24. Thus, the operator positions the U-shaped coupling 20 in the bore hole 22 that is most closely aligned with the center of gravity of the apparatus 10 so that the apparatus 10 hangs from the cable 18 in a generally upright manner. The combination of the counterweight and the upright positioning of the apparatus 10 allows a single operator to easily maneuver the apparatus 10 and position the clamp 12 around the drill pipe 14.

Alternatively, a second embodiment of the means for positioning the apparatus 10 is illustrated by a pair of rails 26 extending generally over the drill pipe 14. A pair of substantially identical brackets 28 extend from the apparatus 10 adjacent the rails 26. Each bracket 28 has a pair of wheels 30, 32 rotatably attached to the brackets and mounted at slightly offset vertical heights. Thus, each pair of wheels 30, 32 has one wheel positioned above and riding on a top surface of the rails 26 and a second wheel positioned below and riding on a bottom surface of the rails 26. The pairs of wheels 30, 32 urge the apparatus to remain in a generally upright position. In this manner, the apparatus 10 is free to roll along the rails 26 so that it is quickly and easily maneuverable into position over the drill pipe 14 by a single operator.

Once the operator has maneuvered the apparatus 10 near the drill pipe 14, he must only move the clamp assembly 12 sufficiently near the drill pipe 14 so that it engages the drill pipe 14. The clamp assembly 12 automatically operates to locate the apparatus 10 so that a safety valve 34 carried by the apparatus !0 is positioned relative to the drill pipe 14 and can be automatically moved into position directly over the drill pipe 14 and lowered and rotated to threadably engage the threaded box end 16. The clamp assembly 12 is connected to a frame assembly 36, which slidably retains a carriage 37 arranged to move horizontally on the frame 36. The carriage 37 includes a body 38 arranged to move vertically on the carriage 37. Thus, it should be appreciated that when the operator first "stabs" the apparatus 10 onto the drill pipe 14, the carriage 37 is fully withdrawn so that the safety valve 34 is not directly above the drill pipe 14. In this manner, fluid flowing from the drill pipe 14 is not sprayed into the operator's field of vision by contact with the safety valve 34 while the operator is attempting to stab the apparatus 10 onto the drill pipe 14. However, once the apparatus 10 is successfully attached to the drill pipe 14, then the carriage 37 is moved toward the drill pipe 14 until the safety valve 34 aligns with the threaded box end 16.

In the embodiments described herein, reference is made to a plurality of hydraulic motors controlled by respective hydraulic control circuits. Those skilled in the art appreciate that pneumatic or electric motors with their accompanying control circuits are readily substitutable for the hydraulic motors described herein without departing from the spirit and scope of the instant invention. Movement of the carriage 37 is effected by a hydraulic motor 40 arranged to drive a threaded screw 42. The threaded screw 42 is supported at each end 44, 46 by bushings 48, 50 disposed in the frame assembly 36. Thus, the threaded screw 42 is free to rotate with rotation of the hydraulic motor 40. The threaded screw 42 passes through a bore 52 extending transversely through the carriage 37. At least a portion of the bore 52 is threaded to match the threaded screw 42 and, preferably, a threaded nut is fixed to the carriage 37 generally coaxial with the bore 52. Thus, rotation of the threaded screw 42 engages the threaded bore 52 and produces transverse movement of the carriage 37 perpendicularly toward and away from the drill pipe 14 in response to clockwise and counter-clockwise rotation of the hydraulic motor 40.

The carriage 37 includes a tapered key 54 of a size and configuration to be received within a tapered slot 56 in the carriage housing 36. Thus, the carriage 37 is not readily separable from the frame assembly 36. It should be noted that the hydraulic motor 40 includes a handwheel 58 attached thereto and adapted for manual rotation of the threaded screw 42 in the event of hydraulic failure.

The body 38 is similarly moveable in the vertical direction by a threaded screw 60 driven by a hydraulic motor 62. The threaded screw 60 is supported at each end 66, 68 by bushings 70, 72 respectively disposed in a lower and upper plate 74, 76 of the carriage 37. Thus, the threaded screw 60 is free to rotate with rotation of the hydraulic motor 40. The threaded screw 60 passes through a bore 64 extending centrally through the body 38. At least a portion of the bore 64 is threaded to match the threaded screw 62 and, preferably, a threaded nut is fixed to the body 38 generally coaxial with the bore 64. Thus, rotation of the threaded screw 60 engages the threaded bore 64 and produces vertical movement of the body 38 axially toward and away from the drill pipe 14 in response to clockwise and counter-clockwise rotation of the hydraulic motor 62.

As will become evident with further description of the apparatus 10, it is important that the body 38 not be allowed to rotate with rotation of the motor 62 and threaded screw 64. Thus, a series of four support rods 78, 80, 82, 84 extend between the lower and upper plates 74, 76 and are each fixed thereto by, for example, a bolt 86 passing through the plate 76 and into a threaded longitudinal bore (not shown) in the support rod 80. Each of the support rods 78, 80, 82, 84 passes through corresponding bores extending vertically through the body 38. Bushings 88, 90 are press fitted into the vertical bores adjacent the top and bottom surfaces of the body 38. These bushings 88, 90 provide a relatively close fit between the body 38 and support rods 78, 80, 82, 84 so that the body 38 accurately moves up and down the threaded screw 60 with minimal binding of the threaded screw 60 in the threaded bore 64.

Once again, it should be noted that the hydraulic motor 62 includes a handwheel 92 attached thereto and adapted for manual rotation of the threaded screw 60 in the event of hydraulic failure.

Vertical movement of the body 38 is associated with like movement of the safety valve 34 so as to move the valve 34 into contact with the threaded box end 16. It should be appreciated that to mate the valve 34 with the threaded box end 16 it is preferred that the safety valve 34, in addition to being moved vertically, also be rotated. Thus, while the safety valve 34 is carried vertically by the body 38 it must also include means for imparting rotation thereto.

Accordingly, a pair of substantially similar upper and lower support brackets 94, 96 extend horizontally from the body 38 and connect to a tubular canister 98 in a manner similar to that described in U.S. Pat. No. 4,442,892, and which is more fully described below. A drive mechanism 100 rotates the canister 98 and the safety valve 34. The drive mechanism 100 includes a hydraulic motor 102 mounted on an upper surface of the upper support bracket 94 with its rotatable shaft extending through an opening 103 in the upper support bracket 94. The hydraulic motor shaft is coupled through an appropriate gear train to a bevel gear 104 that meshes with a corresponding bevel gear 106 extending about the outer circumference of the canister 98. Thus, rotation of the motor 102 effects rotation of the bevel gear 104 and, in turn, rotation of the bevel gear 106 and canister 98, as well as the valve 34.

Figure 6:
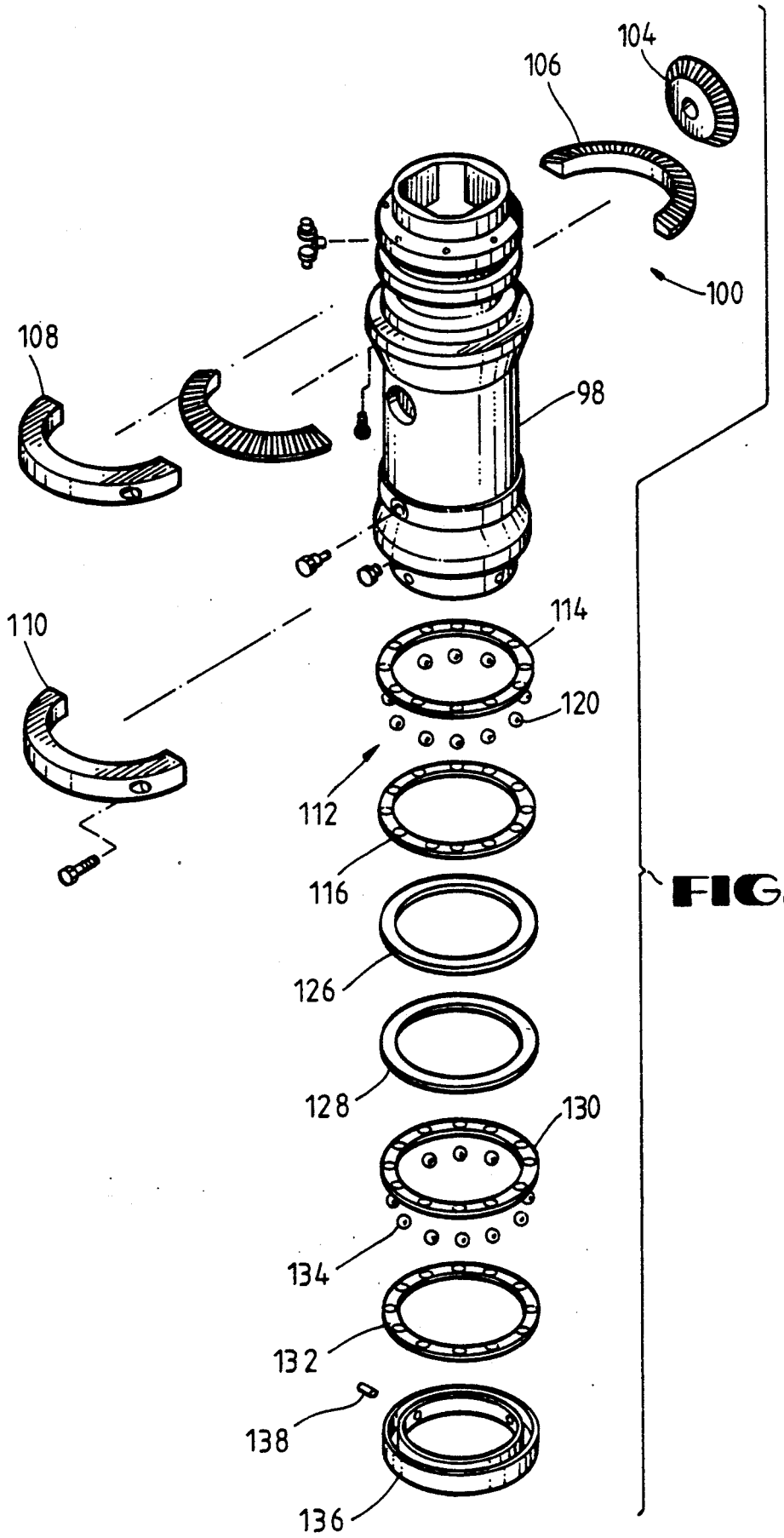
FIG. 6 is an exploded, perspective view of one embodiment of the rotatable canister.

The rotatable mounting of the canister 98 to the upper and lower support brackets 94, 96 can best be appreciated by reference to FIG. 6. The outboard end of the upper and lower support brackets 94, 96 are of a semicircular configuration for engagement with the side wall of tubular canister 98. Engagement of canister 98 with support brackets 94, 96 is similar to engagement of the tubular canister 98 with semicircular clamp members 108, 110 as described in U.S. Pat. No. 4,442,892, which patent is expressly incorporated herein. The bevel gear 106 encircles the canister 98 and is fixed thereto by, for example, allen screws or the like. The bevel gear 104 engages the bevel gear 106 and causes rotation of the canister 98 when bevel gear 104 is rotated by likewise rotation of the hydraulic motor 102.

When the lower support bracket 96 and lower clamp member 110 are coupled to circumferentially engage the canister 98, a relatively flat horizontal surface is provided on the bottom of support bracket 96 and clamp 110 for engagement with a lower bearing assembly 112. The lower bearing assembly 112 includes a bearing race 114, which is of a circular, washer-shaped configuration with sockets spaced thereabout. A bearing race 116 is similar to bearing race 114 and ball bearings 120 are trapped in corresponding sockets of the rack 114 and race 116. The bearing race 114 abuts the lower surface of support bracket 96 and clamp 110. In abutting relationship to bearing race 116 is an outer bearing race 126. A ring 128 abuts race 126 and provides a surface for race 130. The races 130 in combination with a race 132 resemble the arrangement of the races 114, 116 and ball bearings 134 are captured between the races 130, and 132. A lower sleeve bearing retainer 136 has a circular trough in which the race 114, bearing 120, races 116, 126, 128, 130, bearing 134, and race 132 are located. The bearing retainer 136 is secured to the outer periphery of the canister 98 by means of, for example, set screws 138.

When the apparatus 10 is in use and is positioned over a drill pipe joint through which there is an upward flow of fluids or gases, the canister 98 is forced upwardly and a lower bearing assembly 112 is forced into engagement with the lower surface of support bracket 96 and clamp 110. Because of the design of bearing assembly 112, rotation of canister 98 by means of the hydraulic motor 102 or alteratively a manual crank wheel 138 can be accomplished without undue difficulty.

Figure 2:
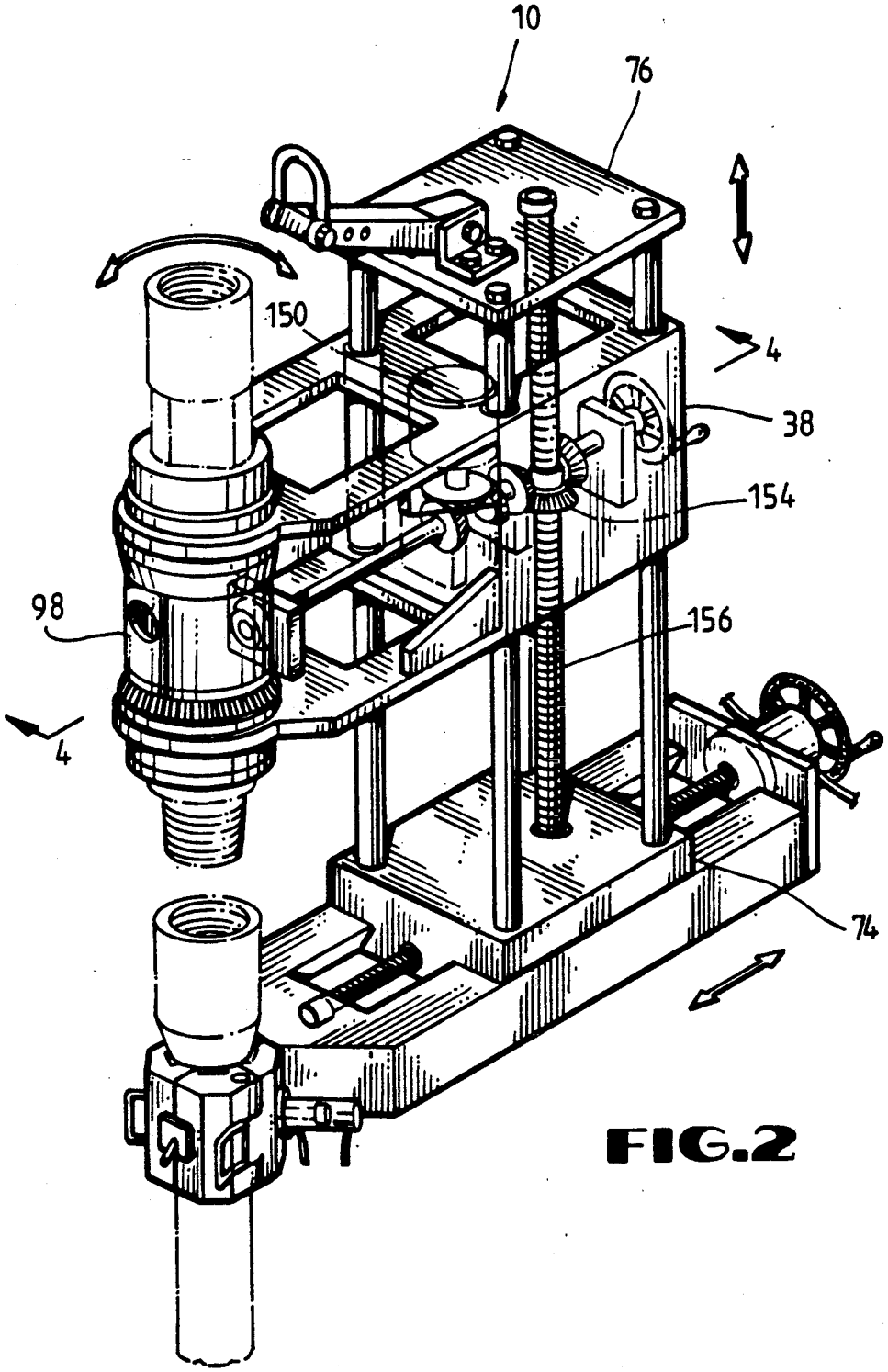
FIG. 2 is a perspective view of a second embodiment of a safety valve stabbing apparatus utilizing the improved clamp assembly, drive assembly, and alignment assembly of the present invention.

Referring now to FIG. 2, a second embodiment of the apparatus 10 is illustrated. The second embodiment is substantially similar to the first embodiment illustrated in FIG. 1 with the exception of the means associated with moving the body 38 vertically and rotating the canister 98. In particular, the means employs a single hydraulic motor 150 for providing both the vertical movement to the body 38 and rotation of the canister 98. While the gear train 152 is slightly more complex in the second embodiment than in the first embodiment, this complexity is offset by the savings arising from the use of a single hydraulic motor. threaded gear 154 to rotate on a fixed threaded shaft 156, unlike the first embodiment where the hydraulic motor 62 drives the threaded screw 60. Thus, the threaded screw 156 is fixed at the upper and lower plates 76, 74 to prevent rotation thereof. Rather rotation of the threaded gear 154 within the body 38 causes the body 38 to travel up and down the threaded screw 156 according to clockwise and counter clockwise rotation of the hydraulic motor 150.

Figure 4:
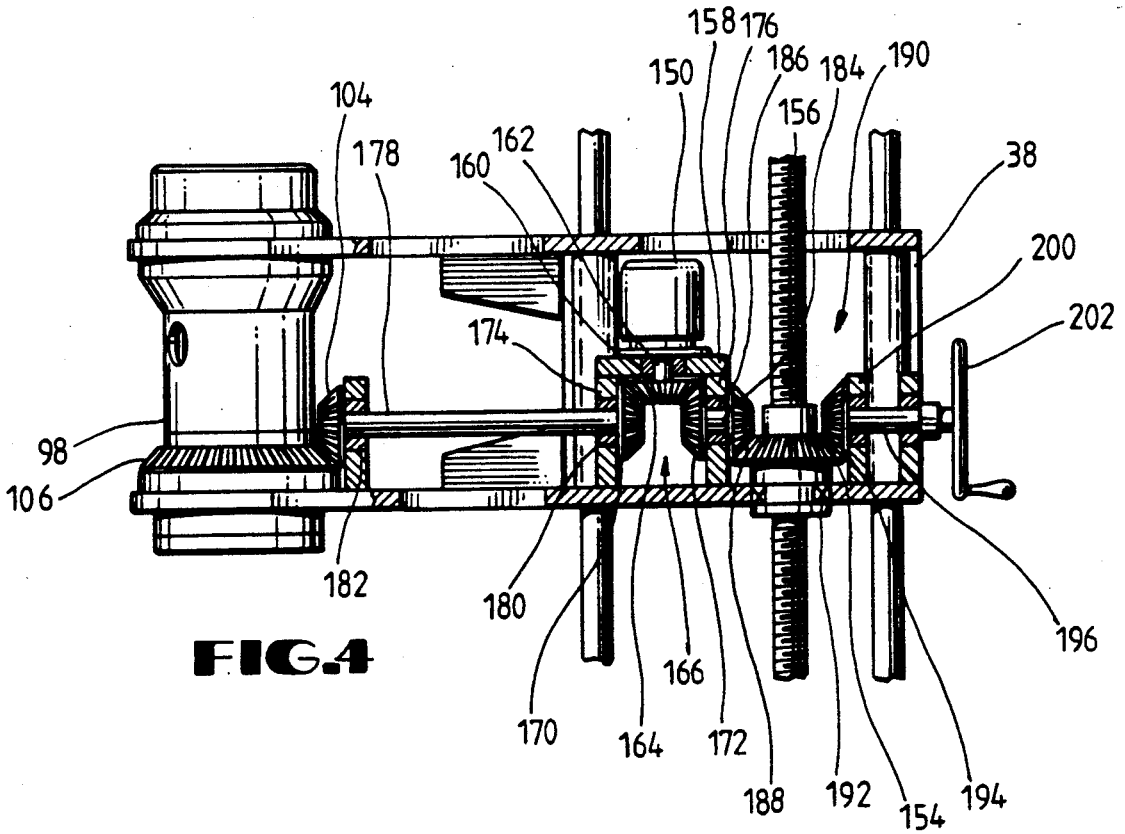
FIG. 4 is a side view of the second embodiment of the drive and alignment assemblies.

Operation of the gear train of the second embodiment can best be appreciated by reference to the side view illustrated in FIG. 4. The hydraulic motor 150 is mounted on a horizontal plate 158 having a central bore 160 extending therethrough. The bore 160 is adapted for receiving a drive shaft 162 of the hydraulic motor 150. The drive shaft 162 is coupled to a beveled pinion gear 164 to supply rotational movement through a differential unit 166 and thereby move the body 38 vertically and rotate the canister 98 at the same time.

The differential 166 includes a pair of bevel gears 170, 172 vertically mounted through plates 174, 176 and adapted for engagement with the beveled pinion gear 164. A shaft 178 is keyed to the bevel gear 170 and extends horizontally toward the canister 98. The bevel gear 104 is keyed to the opposite end of the shaft 178 and engages the bevel gear 106 for driving the canister 98 rotationally. Preferably, the shaft 178 is supported at each end by bushings 180, 182 to encourage relatively easy rotational movement thereof. Similarly, a shaft 184 is keyed to the bevel gear 172 and extends through a bushing 186 in the support bracket 176. The opposite end of the shaft 184 is likewise keyed to a beveled gear 188 that forms a portion of another differential unit 190, which includes the beveled gear 154 mated with the threaded screw 156. The bevel gear 154 is rotatably attached to the body 38 via a conventional bearing assembly 192. Thus, the bevel gear 154 is free to rotate on the threaded screw 156 but cannot move vertically relative to the body 38. Rather, the body 38 is carried up and down the threaded screw 156 with rotation of the bevel gear 154.

The differential 190 includes an additional bevel gear 194 connected to a shaft 196 extending through a bushing 198 and a vertical support bracket 200. The shaft 196 is connected at its opposite end to a conventional handwheel 202 whereby rotation of the handwheel 202 effects vertical movement of the body 38 and rotational movement of the canister 98. The handwheel 202 is intended as a supplement to the hydraulic motor 150 so that in the event of a failure of the hydraulic system, manual operation of the apparatus 10 is still possible.

Figure 3:
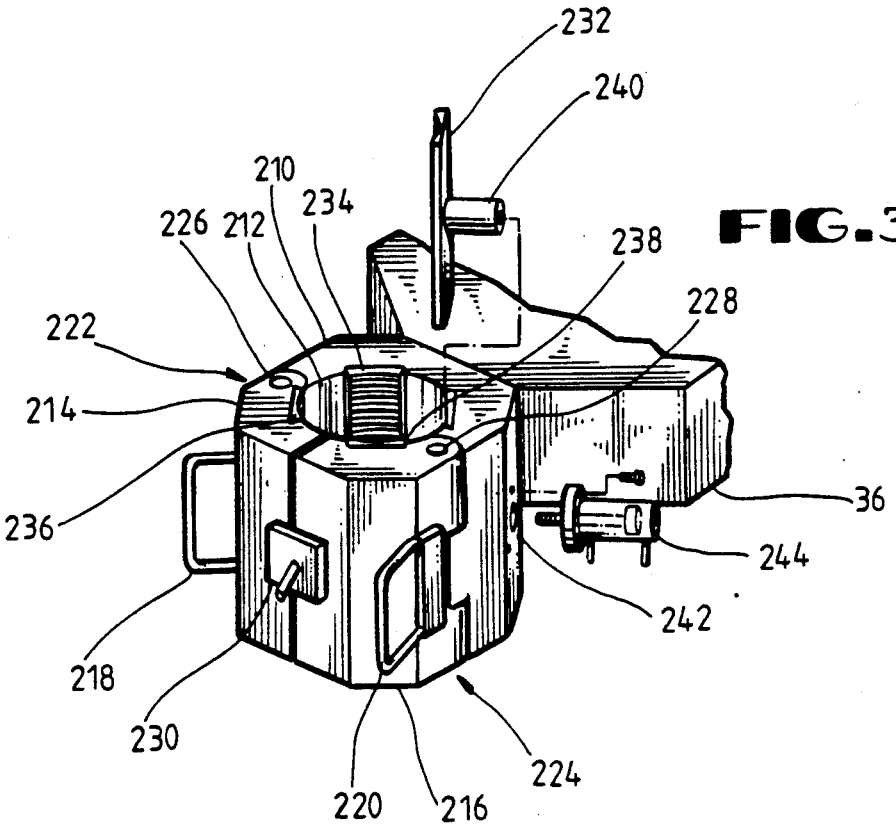
FIG. 3 is a perspective view of an embodiment of the improved clamp assembly.

A preferred embodiment of clamp assembly, or elevator, 12 is illustrated in FIG. 3 and comprises generally four major components. A rear section 210 is connected at its rear surface to the frame assembly 36, while its front surface defines a semi-cylindrical portion of a bore 212. Front sections 214, 216 each define a one quarter cylindrical portion of the bore 212. When the rear section 210 and the front sections 214, 216 are joined, the cylindrical bore 212 is completely defined. The diameter of the bore 212 is generally greater than the expected outside diameter of the drill pipe 14 on which the elevator 12 is used.

Attached to an external face of each of the front sections 214, 216 are handles 218, 220. The front sections 214, 216 are connected to the rear section 210 by hinges 222, 224. The hinges 222, 224 are integrally formed in the front and rear sections 210, 214, 216 and are held together by hinge pins 226, 228. The pins 226, 228, provide vertical axes of rotation about which the handles 218, 220 and front sections 214, 216 rotate. When thus hingably connected, the front sections 214, 216 are rotatable outwardly with respect to one another and with respect to the rear section 210 using handles 218, 220 to open the bore 212 so that the elevator device 12 may be drawn around and clamped to a drill pipe 14.

A releasable latch device 230 is provided so that when the front sections 214, 216 are drawn toward each other to be joined together, the latch device 230 automatically engages to releasably attach the front section 214, 216 and maintain the closed bore 212. Preferably, the front sections 214, 216 are biased to urge the front sections 214, 216 to an open position by, for example, coil springs (not shown) disposed within the hinges 222, 224. When the latch 230 is opened, disconnecting the front sections 214, 216, then the front sections 214, 216 swing outwardly due to the internal bias, releasing the elevator 12 from the drill pipe 14.

Four drill pipe grip sections 232, 234, 236, 238 are positioned within the bore 212 and are removably attached to the inner walls of the rear section 210 and front sections 214, 216. The grip sections 232, 234, 236, 238 are used to reduce the diameter of the bore 212 to properly fit the diameter of the drill pipe 14 on which the elevator 12 is attached. Because of the removability of grip sections 232, 234, 236, 238 various sizes of grips may be utilized to provide flexibility and use of the elevator 12. That is, it can be used on drill pipe 14 of various diameters without a change-out of the entire elevator 12.

The pipe grip sections 232, 234 positioned within the inner face of the rear section 210 each has an arcuate front face and a generally planer rear face with a cylindrical extension 240 protruding therefrom. The cylindrical extension 240 passes through a bore hole 242 extending through the rear section 210 and connecting to a hydraulic cylinder 244 attached to the rear surface of the rear section 210. Thus, it should be appreciated that introduction of hydraulic fluid flow into the hydraulic cylinder 244 results in the grip sections 232, 234 being extended inwardly into the bore 212. Thus, once the operator has positioned the elevator 12 around the drill pipe 14, a hydraulic circuit (more fully described in FIG. 5) is energized to actuate the hydraulic cylinder 244 and engage the grip sections 232, 234 against the sidewalls of the drill pipe 14. In this manner, the elevator 12 quickly and automatically engages the apparatus 10 with the drill pipe 14 in a known, preselected position. For ease in understanding operation of the elevator 12, the pipe grip section 232 and hydraulic cylinder 244 have been shown in an exploded, disassembled position to reveal the inner connections between the pipe grip 232 and hydraulic cylinder 244.

Figure 5A:
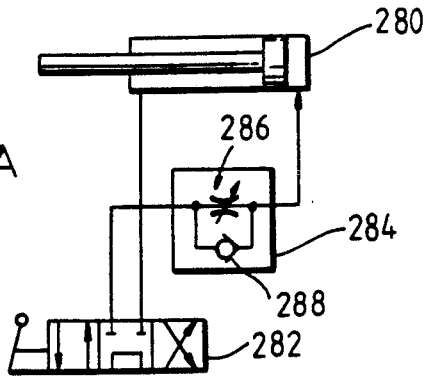
FIGS. 5A–C are schematic diagrams of an embodiment of the hydraulic circuits for operating the clamp, drive, and alignment assemblies.
Figure 5B:
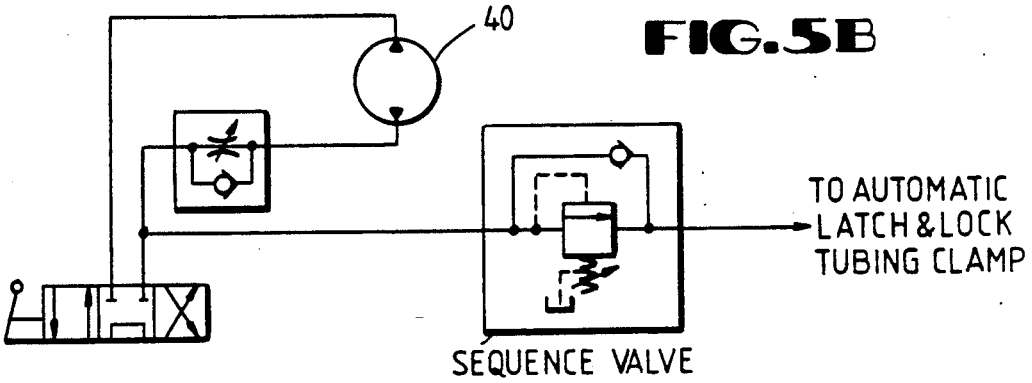
Figure 5C:
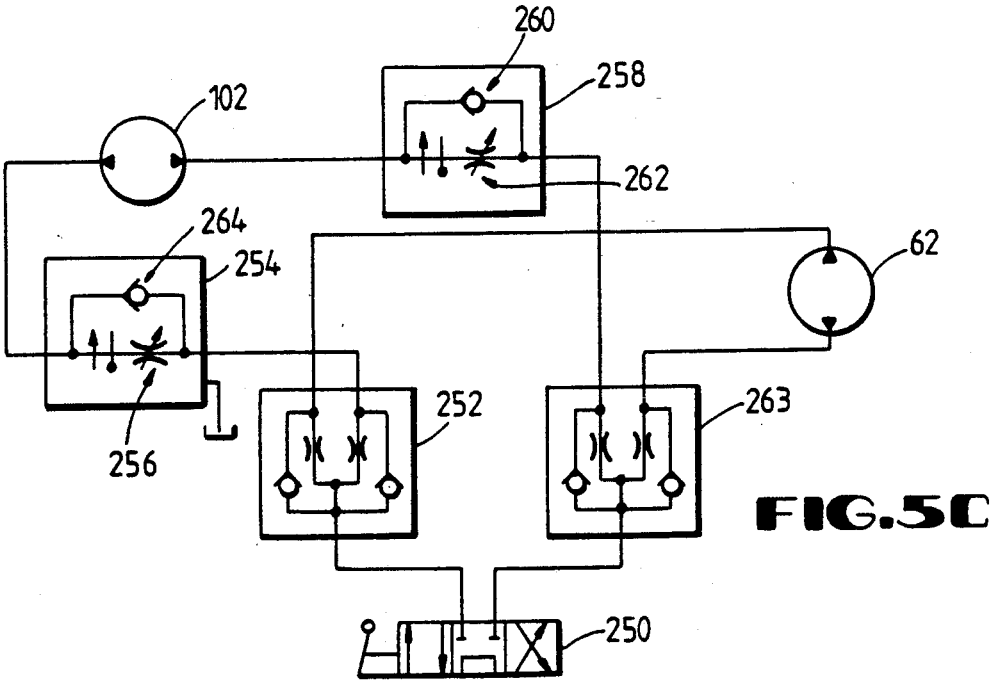

Referring now to FIGS. 5A–C, the hydraulic circuits for controlling movement of the carriage 37, the hydraulic motor 40, and the hydraulic motors 62, 102 are illustrated for the embodiment illustrated in FIG. 1. In the hydraulic circuit of FIG. 5C, the hydraulic motors 102, 62 are substantially identical fixed displacement motors that receive hydraulic fluid flow from an independent source (not shown). The hydraulic fluid source (not shown) is connected to the motors 102, 62 through a directional control valve 250. The output of the directional control valve 250 is connected through a flow dividing valve 252 to one port of each of the motors 102, 62.

It should be appreciated that the relationship between the rotational rates of the motors 102, 62 is determined by the pitch of the threads on the threaded box end 16 and safety valve 34. In other words, the downward vertical movement of the body 38 must correspond to the proper rotational speed of the canister 98 and safety valve 34. Thus, since motors 102, 62 are substantially identical, means is provided for varying the rate of fluid flow to one of the motors 102, 62, depending upon the pitch of the threads employed.

A temperature and pressure compensated flow control valve 254 is disposed between the output of the flow dividing valve 252 and the input port of the hydraulic motor 102. The flow control valve 254 includes a variable orifice 256 that allows the operator to select a flow rate that corresponds to the pitch of the threads employed. The output of the hydraulic motor 102 passes through a temperature and pressure compensated flow control valve 258 connected in an opposite direction to that of the temperature and pressure compensated flow control valve 254. The valve 258 includes a bypass valve 260 configured to pass fluid around its variable orifice 262 when operated in a reverse direction.

Thus, when the directional control valve 250 is operated in a first direction fluid passes through the flow divider 252 into the valve 254 where it passes through the variable orifice 256, through the motor 102, and into the valve 258 where the bypass valve 260 is actuated, removing the variable orifice 262 from the circuit. Fluid then flows into a flow dividing valve 263 where it is recombined with flow passing from the flow dividing valve 252 through the motor 62. Conversely, when the directional control valve 250 is operated in the opposite direction so as to cause the motors 102, 62 to rotate in the opposite direction, the flow passes through the flow dividing valve 263 into the valve 258 where it is passed through the variable orifice 262, through the motor 102, and into the valve 254 where a check valve 264 bypasses the variable orifice 256 and returns the flow to the flow dividing valve 252 where it is combined with the flow passing through the motor 62. Thus, it should be appreciated that operation of the motors 102, 62 in a first direction results in the hydraulic motor 102 turning at a rotational rate corresponding to the setting of the variable orifice 256. Conversely, rotation of the motors 102, 62 in the opposite direction results in the motor 102 turning at a rotational rate corresponding to the setting of the variable orifice 262.

FIG. 5A illustrates a hydraulic circuit for controlling the operation of a hydraulic cylinder 280. The hydraulic cylinder 280 is intended to operate as an alternative embodiment to the hydraulic motor 40 and threaded screw 42 shown in the embodiments of Figs. 1 and 2. The hydraulic cylinder 280 is connected between the carriage 37 and the frame assembly 36 so that extension of the hydraulic cylinder 280 causes the carriage 37 to move in a direction toward the drill pipe 14. A directional control valve 282 receives hydraulic fluid flow from an external hydraulic fluid source (not shown) and passes the fluid flow to the hydraulic cylinder 280 through a temperature and pressure compensated flow control valve 284. The valve 284 includes a variable orifice 286 and a one-way valve 288 arranged in parallel so that hydraulic flow in one direction is bypassed around the variable orifice 286 while hydraulic flow in the opposite direction passes through the variable orifice 286. This arrangement allows for restricted flow in the forward direction of movement with free flow in the reverse direction of movement.

FIG. 5B illustrates a hydraulic control circuit for an embodiment of the elevator 12, which operates to automatically close and clamp onto the drill pipe 14. A directional control valve 300 is manually operated to provide flow to a hydraulic motor 304 and to an automatic latch and lock tubing clamp (not shown). The hydraulic motor 304 operates to engage the grip sections 232, 234 against the pipe 14. The automatic latch and lock tubing clamp (not shown) receives fluid flow through a compensation valve 302. The compensation valve 302 is actuated to pass flow to the automatic latch and lock tubing clamp (not shown) when the pressure in the hydraulic line has risen sufficiently high to actuate the valve 302 (e.g. 500 p.s.i).

Although the above description describes details of a preferred embodiment of the present invention, it will be understood by those skilled in the art that numerous other embodiments and applications of the invention may exist or be developed. Although in many such applications, all of the advantages of the illustrated embodiment may not be achieved, certain desirable attributes may be attainable. The scope of the present invention should accordingly be limited only by the scope of the appended claims.

I claim:

1. An apparatus for threading a valve into a well pipe, the valve being adapted for operative movement between an open and closed position for controlling the flow of fluid therethrough, said valve and said well pipe having a threaded portion with a similar thread pitch, comprising:

a frame;

a clamp assembly coupled to said frame and adapted for coupling with said well pipe;

a carriage coupled to said frame and adapted for horizontal linear movement relative to said frame, said carriage being linearly moveable between first and second horizontal positions;

a body coupled to said carriage and adapted for vertical, linear movement relative to said carriage, said body being movable between first and second vertical positions;

said valve being coupled to said body and adapted for horizontal and vertical linear movement with said body and rotation relative to said body, said valve being vertically and horizontally spaced from said well pipe in said first vertical and horizontal positions respectively, and horizontally aligned with and vertically coupled to said well pipe in said second vertical and horizontal positions respectively;

first drive means for urging said carriage between said first and second horizontal positions;

second drive means for coordinating rotation and vertical displacement of said valve, said drive means being operative to thread said valve into a plurality of drill pipe thread pitches.

2. An apparatus, as set forth in claim 1, wherein said first drive means includes, a motor, a threaded rod coupled to and rotatable with said motor, and a threaded nut coupled to said carriage and threadably engaged with said threaded rod whereby rotation of said threaded rod in a first direction urges said carriage toward said first position and rotation of said threaded rod in a second direction urges said carriage toward said second position.

3. An apparatus, as set forth in claim 2, wherein said motor is a hydraulic motor.

4. An apparatus, as set forth in claim 1, wherein said second drive means includes, a first motor, a threaded rod coupled to and rotatable with said first motor, and a threaded nut coupled to said body and threadably engaged with said threaded rod whereby rotation of said threaded rod in a first direction urges said body toward said first position and rotation of said threaded rod in a second direction urges said body toward said second position.

5. An apparatus, as set forth in claim 4, wherein said first motor is a hydraulic motor.

6. An apparatus, as set forth in claim 4, wherein said second drive means includes a second motor adapted for rotating said valve, and means for controlling the speed of at least one of said first and second motors as a function of the thread pitch of said valve and said well pipe.

7. An apparatus, as set forth in claim 6, wherein said first and second motors are hydraulic motors and said controlling means includes means for varying hydraulic fluid flow rates to at least one of said first and second motors as a function of the thread pitch of said valve and said well pipe.

8. An apparatus, as set forth in claim 7, wherein said varying means includes a control valve having a manually variable orifice.

9. An apparatus for threading a valve into a well pipe, the valve being adapted for operative movement between an open and closed position for controlling the flow of fluid therethrough, said valve and said well pipe having a threaded portion with a similar thread pitch, comprising:

a frame;

a clamp assembly coupled to said frame and adapted for coupling with said well pipe;

a carriage coupled to said frame and adapted for horizontal, linear movement relative to said frame, said carriage being linearly movable between first and second horizontal positions;

a body coupled to said carriage and adapted for vertical, linear movement relative to said carriage, said body being movable between first and second vertical positions;

said valve being coupled to said body and adapted for horizontal and vertical linear movement with said body and rotation relative to said body, said valve being vertically and horizontally spaced from said well pipe in said first vertical and horizontal positions respectively, and horizontally aligned with and vertically coupled to said well pipe in said second vertical and horizontal positions respectively;

first drive means for urging said carriage between said first and second horizontal positions;

second drive means for coordinating rotation and vertical displacement of said valve, said second drive means including a first hydraulic motor adapted for urging said body between said first and second vertical positions, a second hydraulic motor adapted for rotating said valve, and means for controlling the speed of at least one of said first and second motors as a function of the thread pitch of said valve and said well pipe.

10. An apparatus, as set forth in claim 9, wherein said first drive means includes, a motor, a threaded rod coupled to and rotatable with said motor, and a threaded nut coupled to said carriage and threadably engaged with said threaded rod whereby rotation of said threaded rod in a first direction urges said carriage toward said first position and rotation of said threaded rod in a second direction urges said carriage toward said second position.

11. An apparatus, as set forth in claim 10, wherein said motor is a hydraulic motor.

12. An apparatus, as set forth in claim 9, wherein said second drive means includes, a threaded rod coupled to and rotatable with said first motor, and a threaded nut coupled to said body and threadably engaged with said thread rod whereby rotation of said threaded rod in a first direction urges said body toward said first position and rotation of said threaded rod in a second direction urges said body toward said second position.

13. An apparatus, as set forth in claim 12, wherein said first motor is a hydraulic motor.

14. An apparatus, as set forth in claim 9, wherein said first and second motors are hydraulic motors and said controlling means includes means for varying hydraulic fluid flow rate to at least one of said first and second motors as a function of the thread pitch of said valve and said well pipe.

15. An apparatus, as set forth in claim 14, wherein said varying means includes a control valve having a manually variable orifice.

16. An apparatus for threading a valve into a well pipe, the valve being adapted for operative movement between an open and closed position for controlling the flow of fluid therethrough, said valve and said well pipe having a threaded portion with a similar thread pitch, comprising:

a frame having a first longitudinal axis;

a clamp assembly coupled to said frame and adapted for coupling with said well pipe, said clamp assembly extending from said frame along a second longitudinal axis perpendicular to said first longitudinal axis;

a carriage coupled to said frame and adapted for horizontal, linear movement relative to said frame along said second longitudinal axis, said carriage being linearly movable between first and second horizontal positions;

a body coupled to said carriage and adapted for vertical, linear movement relative to said carriage within a plane defined by said first and second longitudinal axes, said body being movable between first and second vertical positions;

said valve being coupled to said body in the plane defined by said first and second longitudinal axes and adapted for horizontal and vertical linear movement with said body and rotation relative to said body, said valve being vertically and horizontally spaced from said well pipe in said first vertical and horizontal positions respectively, and horizontally aligned with and vertically coupled to said well pipe in said second vertical and horizontal positions respectively;

first drive means for urging said carriage between said first and second horizontal positions;

second drive means for coordinating rotation and vertical displacement of said valve, said drive means being operative to thread valve into a plurality of drill pipe thread pitches.

17. An apparatus, as set forth in claim 16, wherein said first drive means includes, a motor, a threaded rod coupled to and rotatable with said motor, and a threaded nut coupled to said carriage and threadably engaged with said threaded rod whereby rotation of said threaded rod in a first direction urges said carriage toward said first position and rotation of said threaded rod in a second direction urges said carriage toward said second position.

18. An apparatus, as set forth in claim 16, wherein said second drive means includes, a first motor, a threaded rod coupled to and rotatable with said first motor, and a threaded nut coupled to said body and threadably engaged with said threaded rod whereby rotation of said threaded rod in a first direction urges said body toward said first position and rotation of said threaded rod in a second direction urges said body toward said second position.

19. An apparatus, as set forth in claim 18, wherein said second drive means includes a second motor adapted for rotating said valve, and means for controlling the operation of said first and second motors to first and second rotational speeds responsive to the pitch of said valve and said well pipe.

20. An apparatus, as set forth in claim 19, wherein said first and second motors are hydraulic motors and said controlling means includes means for varying hydraulic fluid flow rate to at least one of said first and second motors as a function of the pitch of said valve and said well pipe.

* * * * *

UNITED STATES PATENT AND TRADEMARK OFFICE

CERTIFICATE OF CORRECTION

PATENT NO. : 5,092,399

DATED : March 3, 1992

INVENTOR(S) : Duane Lang

It is certified that error appears in the above-indentified patent and that said Letters Patent is hereby corrected as shown below:

Column 2, line 16, delete "will" and insert --well--.

Column 2, line 68, delete "slip" and insert --slips--.

Column 6, line 8, before "threaded" insert --In the second embodiment, the hydraulic motor 150 drives a--.

Column 6, line 65, delete "one quarter" and insert --one-quarter--.

Column 12, line 22, after "thread" insert --said--.

Signed and Sealed this

Sixth Day of July, 1993

*Attest:*

Michael K. Kirk

MICHAEL K. KIRK

*Attesting Officer*

*Acting Commissioner of Patents and Trademarks*